US012404467B2

(12) United States Patent
Mattingly

(10) Patent No.: US 12,404,467 B2
(45) Date of Patent: Sep. 2, 2025

(54) SYSTEMS AND METHODS FOR AUTOMATED TANK MONITORING AND BLENDING

(71) Applicant: Texon Midstream, LLC (f/k/a Texon BlendTech, LLC), Houston, TX (US)

(72) Inventor: Larry D. Mattingly, Sanford, FL (US)

(73) Assignee: Texon Midstream, LLC, Houston, TX (US)

( * ) Notice: Subject to any disclaimer, the term of this patent is extended or adjusted under 35 U.S.C. 154(b) by 0 days.

(21) Appl. No.: 17/838,300

(22) Filed: Jun. 13, 2022

(65) Prior Publication Data

US 2022/0403267 A1 Dec. 22, 2022

Related U.S. Application Data

(60) Provisional application No. 63/212,154, filed on Jun. 18, 2021.

(51) Int. Cl.
*C10L 1/16* (2006.01)

(52) U.S. Cl.
CPC ..... *C10L 1/1608* (2013.01); *C10L 1/1616* (2013.01); *C10L 2200/0423* (2013.01); *C10L 2230/14* (2013.01); *C10L 2270/10* (2013.01); *C10L 2300/20* (2013.01)

(58) Field of Classification Search
CPC ..... C10L 1/06; C10L 1/1608; C10L 1/1616; C10L 2200/0423; C10L 2230/14; C10L 2270/023; C10L 2270/10; C10L 2290/58; C10L 2300/20
See application file for complete search history.

(56) References Cited

U.S. PATENT DOCUMENTS

| | | | | |
|---|---|---|---|---|
| 4,523,928 | A | 6/1985 | Hillman et al. | |
| 6,679,302 | B1 * | 1/2004 | Mattingly | C10L 1/06 141/83 |
| 7,032,629 | B1 | 4/2006 | Mattingly et al. | |
| 8,518,131 | B2 | 8/2013 | Mattingly et al. | |
| 9,080,111 | B1 | 7/2015 | Huff et al. | |
| 2003/0195708 | A1 | 10/2003 | Brown | |
| 2005/0022446 | A1 | 2/2005 | Brundage et al. | |
| 2005/0058016 | A1 | 3/2005 | Smith et al. | |
| 2006/0278304 | A1 * | 12/2006 | Mattingly | G05B 19/4166 141/100 |
| 2007/0034550 | A1 | 2/2007 | Hedrick et al. | |

(Continued)

FOREIGN PATENT DOCUMENTS

| | | | |
|---|---|---|---|
| EP | 1914291 | A2 | 4/2008 |
| WO | 2007/124058 | A2 | 11/2007 |
| WO | 2014/065886 | A2 | 5/2014 |

OTHER PUBLICATIONS

Haskell et al.; Front-End Volatility of Gasoline Blends; Industrial and Engineering Chemistry; Feb. 1942, 4 pp.

(Continued)

*Primary Examiner* — Latosha Hines
(74) *Attorney, Agent, or Firm* — Clark G. Sullivan

(57) ABSTRACT

Provided are automated systems and methods for measuring the physical properties of fuels in large storage tanks, and for blending butane into the fuels, including chemometric methods for controlling physical properties selected from volatility, butane content, and density of the fuel during the blending process.

16 Claims, 4 Drawing Sheets

(56) References Cited

U.S. PATENT DOCUMENTS

| | | | | |
|---|---|---|---|---|
| 2017/0211004 | A1 | 7/2017 | Vanderbur | |
| 2019/0325668 | A1 | 10/2019 | Cole et al. | |
| 2020/0339886 | A1* | 10/2020 | Mattingly | F17D 1/17 |

OTHER PUBLICATIONS

Mid-Continent Energy Company Inc.; PCT/US2022/033322 filed Jun. 14, 2022; International Search Report and Written Opinion; ISA/US; mailed Sep. 27, 2022; 17 pp.

Mid-Content Energy Company, Inc., International Application No. PCT/US2022/033322 filed Jun. 14, 2022; International Preliminary Report on Patentability; International Bureau of WIPO; Dec. 14, 2023; 14 ppl.

* cited by examiner

SYSTEMS AND METHODS FOR AUTOMATED TANK MONITORING AND BLENDING

FIELD OF THE INVENTION

The present invention relates to refined hydrocarbon products in storage tanks, and to automated methods for optimizing the physical properties of those products through automated monitoring and the controlled addition of discreet hydrocarbon components such as butane.

BACKGROUND OF THE INVENTION

Worldwide, despite innovations in electric vehicle technology, gasoline remains the predominant fuel for transportation. Gasoline must meet the operational requirements of modern combustion engines, stringent environmental and industrial standards, and biofuel blending mandates.

The United States Environmental Protection Agency ("EPA") and other regulatory authorities impose specifications for Reid Vapor Pressure ("RVP") on gasoline depending on the season and the location in which the gasoline is sold. RVP is the vapor pressure of the gasoline measured at 100° F. Because atmospheric pressure is around 14.7 pounds per square inch (psi), in order to reduce volatilization of the gasoline, the EPA requires that the RVP of summer gasoline blends not exceed 7.8 psi in some areas of the country and 9.0 psi in others. Retail stations start selling a winter gasoline blend with a higher RVP usually by mid-September.

A gasoline's RVP is a function of each hydrocarbon component in the blend, and the RVP of each component. Butane is a relatively inexpensive component in gasoline, but it has the highest vapor pressure at around 52 psi. This means that in the summer, the fraction of butane in gasoline must be kept low to prevent volatilization of the gasoline, while in winter the fraction of butane can be higher.

Gasoline supplies can be expanded and their physical properties altered by the addition of butane and other light fraction hydrocarbons when their RVP is less than the maximum allowed. An exemplary refinery blending process is disclosed in Mayer, U.S. Pat. No. 3,751,644. This patent, which is owned by Sun Oil Company, describes a system for automatically adjusting the amount of butane added to a gasoline stream at a petroleum refinery, based on continuous measurements of the Reid vapor pressure of the gasoline downstream from the point of blending.

Bajek's U.S. Pat. No. 3,999,959, which is owned by Universal Oil Products Company, also discloses a system for blending butane and gasoline at a petroleum refinery. The Bajek system blends butane with a low-octane gasoline stream and a high-octane gasoline stream, and then analyzes the blended gasoline to measure characteristics such as Reid vapor pressure and vapor to liquid ratio.

Efforts at blending butane at a terminal tank farm have also recently been undertaken. As described in U.S. Pat. No. 6,679,302, butane can be blended in-line with a gasoline stream immediately before the gasoline is dispensed to a tanker truck, and after it has been withdrawn from the storage tank.

Several methods have been attempted to improve the precision of butane blending and the predictability of Reid vapor pressure in the final gasoline product. The Grabner unit is a substantial advance in this respect. The Grabner unit (manufactured by Grabner International) is a measuring device capable of providing Reid vapor pressure and vapor to liquid ratio data for a gasoline sample typically within 6-11 minutes of introducing the sample to the unit. It has been employed at some refineries to measure the volatility of gasoline consistently, and at tank farms in in-line blending systems to blend butane with the gasoline based upon an allowable Reid vapor pressures.

What is needed are more precise systems for blending butane and other hydrocarbons into gasoline at the tank farm, particularly into large storage tanks at tank farms, preferably on an automated basis, to optimize the allowable RVP in gasoline depending on the season.

SUMMARY OF THE INVENTION

The inventors have developed versatile automated systems for blending butane into fuel contained in large storage tanks located on tank farms serviced by pipeline, ships, and other means of bulk transport. Blending butane into these large storage tanks, particularly on an automated basis, can be especially challenging due to the lack of homogeneity within the tank, the need for rapid test results corresponding to the rapid rate at which butane must be added to the tank during blending, and the lack of reliable technologies for accurately generating such rapid test results. In one particular embodiment, the methods are performed by comparing infra-red spectrographs generated from multiple samples of fuel from the storage tank, from multiple locations in the tank, with chemometric datasets generated from the same type of fuel.

Thus, in a first principal embodiment the invention provides a chemometrically controlled system for automated tank monitoring and butane blending comprising: (a) a fuel storage tank comprising a volume of tank fuel, wherein the tank fuel is characterized by type and a physical property selected from volatility, butane content, and density; (b) a variable rate butane blending unit comprising a tank fuel inlet, a tank fuel outlet, and a butane inlet; (c) a tank fuel circulating line comprising: (i) a tank fuel withdrawal line providing fluid communication between a tank fuel withdrawal port on the storage tank and the tank fuel inlet on the butane blending unit; (ii) a tank fuel return line providing fluid communication between the tank fuel outlet on the butane blending unit and a tank fuel return port on the storage tank; (d) a butane supply in fluid communication with the butane inlet on the butane blending unit; (e) a plurality of tank fuel sampling units, each comprising: (i) a sampling line providing fluid communication between a sampling port on the tank and a near infrared ("IR") analyzer capable of generating an absorption spectrograph of the tank fuel; and (ii) an optional sample return line providing fluid communication between the infrared analyzer and the tank; (f) an information processing unit ("IPU") comprising (i) access to a chemometric dataset corresponding to a range of physical properties of the tank fuel, and (ii) programming for performing the following IPU functions: receiving the spectrograph from the IR analyzer, comparing the spectrograph to the chemometric dataset, determining the physical property of the tank fuel, and generating a signal corresponding to the physical property; (g) performing a comparison of the physical property to a physical property limit; and (h) reducing the fluid communication of the butane supply in response to the comparison.

The invention can also be practiced using techniques other than IR-coupled chemometrics, using commercially available units for measuring the physical property of the fuel. Thus, in a second embodiment the invention provides a system for automated tank blending comprising: (a) a fuel storage tank comprising a volume of tank fuel, wherein the tank fuel comprises a physical property selected from volatility, butane content, and density; (b) a variable rate butane blending unit comprising a tank fuel inlet, a tank fuel outlet, and a butane inlet; (c) a tank fuel circulating line comprising: (i) a tank fuel withdrawal line providing fluid communication between a tank fuel withdrawal port on the storage tank and the tank fuel inlet on the butane blending unit; (ii) a tank fuel return line providing fluid communication between the tank fuel outlet on the butane blending unit and a tank fuel return port on the storage tank; (d) a butane supply in fluid communication with the butane inlet on the butane blending unit; (e) a plurality of tank fuel sampling units, each comprising: (i) a sampling line providing fluid communication between a sampling port on the tank and a physical property analysis unit capable of measuring the physical property of the tank fuel and generating a signal corresponding to the measured physical property; and (ii) an optional sample return line providing fluid communication between the physical property analysis unit and the tank; and (f) an information processing unit ("IPU") comprising programming for performing the following IPU functions: receiving the signals from the sampling units, determining the physical property of the fuel, and generating a signal corresponding to the physical property; (g) performing a comparison of the physical property to a physical property limit; and (h) reducing the fluid communication of the butane supply in response to the comparison.

The invention can also be described in terms of the methods for carrying it out. Thus, in a third principal embodiment the invention provides a chemometric method of automated tank blending comprising: (a) providing a fuel storage tank comprising a height and a volume of tank fuel within the tank; (b) periodically withdrawing samples of the tank fuel from the tank, at uniform intervals of time, from a plurality of locations along the height of the tank; (c) measuring the physical property of the samples in a near infrared ("IR") analyzer; (d) withdrawing tank fuel from the tank; (e) adding butane to the withdrawn tank fuel at a butane blending unit at a rate that will not cause a limit on the physical property to be exceeded; and (f) optionally returning the withdrawn tank fuel to the tank.

In a fourth principal embodiment the invention provides a method of automated tank blending comprising: (a) providing a fuel storage tank comprising a height and a volume of tank fuel within the tank; (b) periodically withdrawing samples of the tank fuel from the tank, at uniform intervals of time, from a plurality of locations along the height of the tank; (c) measuring the physical property of the samples in an automated physical property analysis unit; (d) withdrawing tank fuel from the tank; (e) adding butane to the withdrawn tank fuel at a butane blending unit at a rate that will not cause a limit on the physical property to be exceeded; and (f) optionally returning the withdrawn tank fuel to the tank.

Additional advantages of the invention are set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A better understanding of the present invention can be obtained when the following detailed description of the disclosed embodiments is considered in conjunction with the following drawings, in which.

DETAILED DESCRIPTION

Definitions and Use of Terms

Figure 1:
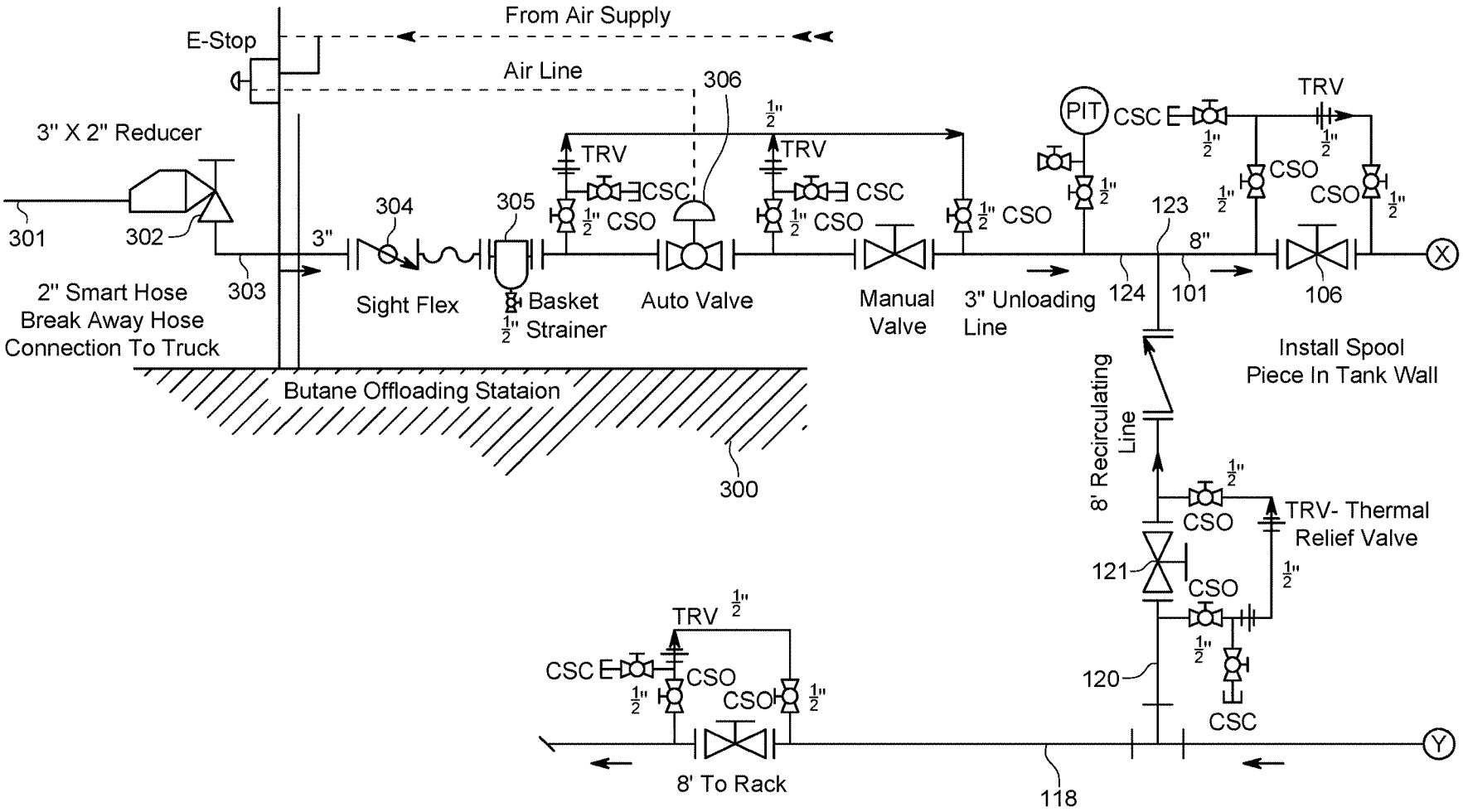
FIG. 1 is a schematic of an in-tank butane blending system of the current invention showing a recirculating gasoline loop, a discharge to a rack loading system, an input from a source of butane such as a butane truck, and the means by which the rate of butane delivery is controlled.
Figure 1:
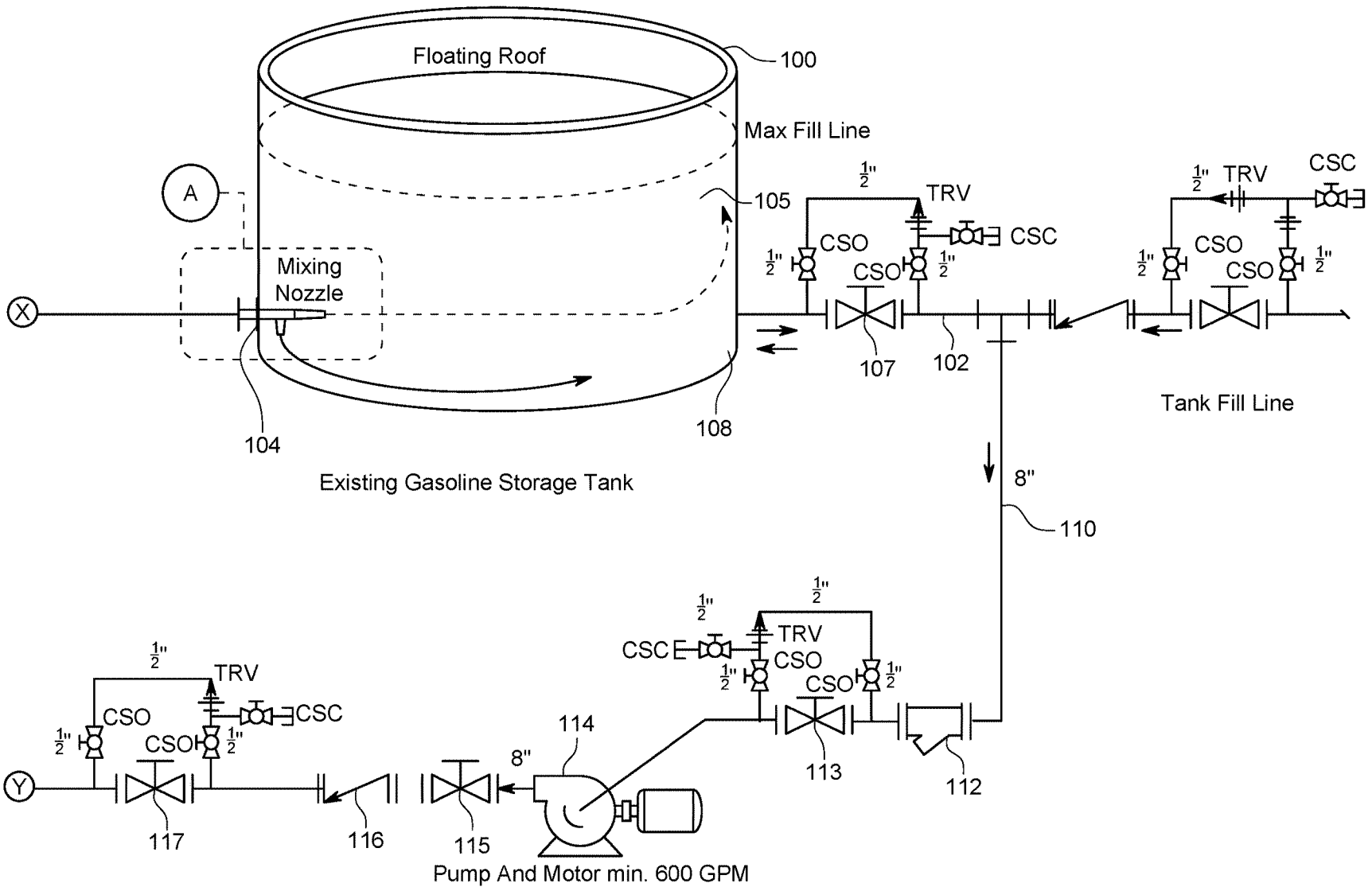

As used in the specification and claims, the singular forms "a," "an," and "the" include plural references unless the context clearly dictates otherwise. The word "or" and like terms as used herein means any one member of a particular list and also includes any combination of members of that list.

The invention is defined in terms of principal embodiments and subembodiments. When an embodiment or subembodiment other than the principal embodiment is discussed herein, it will be understood that the embodiment or subembodiment can be applied to further limit any of the principal embodiments. It will also be understood that the elements and subembodiments can be combined to create another distinct subembodiment encompassed by the present invention.

When an element of a process or thing is defined by reference to one or more examples, components, properties or characteristics, it will be understood that anyone or combination of those components, properties or characteristics can also be used to define the subject matter at issue. This might occur, for example, when specific examples of an element are recited in a claim (as in a Markush grouping), or an element is defined by a plurality of characteristics. Thus, for example, if a claimed system comprises element A defined by elements A1, A2 and A3, in combination with element B defined by elements B1, B2 and B3, the invention will also be understood to cover a system defined by element A without element B, a system in which element A is defined by elements A1 and A2 in combination with element B defined by elements B2 and B3, etc.

"ASTM" refers to the American Society for Testing and Materials. Whenever a petroleum type is referenced herein, it will be understood that the type can be defined by specifications and testing methods prescribed by ASTM in its various publications. The exact methods prescribed by ASTM need not be practiced, as long as the specifications and limits prescribed by ASTM are observed. Unless otherwise indicated, when reference is made to an ASTM standard herein, it is made in reference to the ASTM standard in effect on Jan. 1, 2021, and the ASTM standard is incorporated herein by reference.

"Butane" has its usual meaning in fuel contexts; it refers to a composition consisting substantially of $C_4H_{10}$ hydrocarbons, and as used herein may refer to either n-butane or iso-butane where the isomer is not specified. The term includes commercially available butane in the presence of like-fraction hydrocarbons. In various embodiments, the term requires the hydrocarbon content to be at least 80%, 90%, 95%, or 98% $C_4H_{10}$.

"Condensate" means natural gas liquids (usually $C_5$-$C_{12}$ hydrocarbons) obtained from the extraction and/or production of natural gas.

"Conventional Blendstock for Oxygenate Blending" or "CBOB" means motor gasoline blending components intended for blending with oxygenates to produce finished conventional motor gasoline. "Reformulated Blendstock for Oxygenate Blending" or "RBOB" refers to motor gasoline blending components intended for blending with oxygenates to produce finished reformulated motor gasoline. "Premium Blendstock for Oxygenate Blending" or "PBOB" refers to motor gasoline blending components intended for blending with oxygenates to produce premium finished reformulated motor gasoline.

"Density" means the density of a substance as a function of mass per unit volume. The density can be reported directly, in terms of mass per unit volume, or indirectly using measures such as specific gravity. A preferred method of measuring the density of a diluent stream is reported as ASTM standard method 4052, conducted at 15° C., using a suitable commercially available density measuring device. A suitable range of density for the diluent stream in this application, when measured according to the foregoing method, is from 600 to 799 kg/m$^3$. Alternatively or in addition, density can be measured in terms of specific gravity or its corollary, API gravity, where the specific gravity of butane is 0.584, and the API gravity of butane is 110.8 API gravity and specific gravity are related according to the following formulae: API Gravity at 60° F.=(141.5/SG)−131.5; Specific Gravity at 60° F.=141.5/(API Gravity+131.5). Preferred limits on API gravity for the diluent stream, when measured according to ASTM D4052 at 60° F., are from 46 to 86.

"Diluent" means hydrocarbon added to crude, heavy naphtha, bitumen or other dense petrochemical material to reduce the viscosity or density of such material. A common source of diluent is natural gas condensate obtained during the extraction of natural gas. Other diluent sources include but are not limited to: light conventional produced hydrocarbon oils, refinery naphtha (i.e. straight run hydrocarbons from the refinery process, especially light naphtha) and synthetic crude oils. "Diluent" refers to hydrocarbons derived from a single source as well as pooled diluent streams. A diluent, by definition, preferably contains substantially virgin (uncracked) hydrocarbons, although trace amounts of cracked hydrocarbons (<5, 2 or 1%) are acceptable.

"Distillation Temperature" refers to the. temperature at which a given percentage of a liquid will evaporate at atmospheric pressure. Thus, T90 refers to the temperature at which 90% of a liquid will evaporate under atmospheric pressure. Values for conventional and oxygenated gasolines are prescribed by ASTM D 4814. Test methods are prescribed in ASTM 5188.

"Finished Gasoline" and "Finished Motor Gasoline" are used synonymously and refer to gasoline that is suitable for burning in spark-ignition vehicles without further modifications. Finished gasoline will typically satisfy ASTM Specification D 4814 or Federal Specification VV-G-1690C, and is characterized as having a boiling range of 122 to 158 degrees Fahrenheit at the 10 percent recovery point to 365 to 374 degrees Fahrenheit at the 90 percent recovery point. "Conventional Gasoline" means finished motor gasoline not included in the oxygenated or reformulated gasoline categories.

"Fluid communication" refers to the linkage of a pipe to a source of a fluid at the same facility. Optionally the linkage may be through a channel that can be closed or whose flow may be modulated as by a valve. The linkage may be by any of the following: a door or window on the side of the pipeline; a branching pipe in the pipeline; an injection-facilitating fixture in a joint of the pipeline; a smaller secondary pipe that extends into the interior of the pipeline; or any other means that permits a fluid to flow into the pipeline. Optionally the flow may be constant, variable, or intermittent. In certain preferred embodiments of the invention the fluid flow into the pipe by means of this linkage is capable of being modulated or stopped.

"Gasoline" refers to a refined mixture of relatively volatile hydrocarbons with or without small quantities of additives, blended to form a fuel suitable for use in spark-ignition engines. The term includes finished gasoline and gasoline/ethanol mixtures, as well as fuels that are intended to be mixed with oxygenates such as ethanol and MTBE. Gasoline thus includes conventional gasoline; oxygenated gasoline such as gasohol; reformulated gasoline; reformulated blendstock for oxygenate blending; and conventional blendstock for oxygenate blending.

"Informational database" or "IDB" refers to a data storing system which can receive, store and output data. The informational database communicates with or is accessible to other informational database(s), IPU(s), component(s), system(s) and device(s) encompassed by the methods and systems of the present invention. When an IDB is modified by the term "an," it will be understood that the invention contemplates that one or more IDB's may perform the function described for the IDB. In like manner, when the text refers to two or more IDBs for performing distinct functions, without specifically stating that the IDBs are different, it will be understood that the two or more IDBs can be the same or different.

"Information processing unit" and "IPU" means a computational unit that is useful for at least one of accessing, receiving, processing, distributing and storing data. The IPU may receive data either passively or by affirmatively soliciting or searching for data on a separate information system. When an IPU is modified by the term "an," it will be understood that the invention contemplates that one or more IPU's may perform the function described for the IPU; that the same IPU can perform more than one of the functions described for IPUs in the relevant text; and that the functions described for IPUs in the relevant text can be distributed among multiple IPUs. Thus, when text refers to two or more IPUs for performing distinct functions, without specifically stating that the IPUs are different, it will be understood that the two or more IPUs can be the same or different.

"Reid vapor pressure (RVP)" means the absolute vapor pressure exerted by a liquid at 100° F. (37.8° C.), corresponding to the value obtained when determined by the test method of ASTM-D-5191.

"Reformulated Gasoline (RFG)" refers to finished gasoline formulated for use in motor vehicles, the composition and properties of which meet the requirements of the reformulated gasoline regulations promulgated by the U.S. Environmental Protection Agency under Section 211(k) of the U.S. Clean Air Act and in effect on Jan. 1, 2019. Reformulated gasoline excludes Reformulated Blendstock for Oxygenate Blending (RBOB).

"Tank farm" means any facility that contains a number of large storage tanks for petroleum products, serviced by bulk transport facilities such as ships or pipelines originating off-site for delivering petroleum products, and often including loading racks from which tanker trucks can be filled. The methods and systems of the current invention occur at tank farms downstream of a petroleum refinery.

"Volatility" means the relative tendency of a liquid to vaporize, and can be measured by any suitable measure, including Reid vapor pressure, dry vapor pressure equivalent, vapor liquid ratio, or distillation temperature. Given the dominant role played by butane in a fuel's vapor pressure, volatility can also be measured by measuring the fuel's butane content.

When data or a signal is referred to herein as being transmitted between two IPUs or an IPU and an information database, or other words of like import such as "communicated" or "delivered" are used, it will be understood that the transmission can be indirect, as when an intermediate IPU receives and forwards the signal or data. It will also be understood that the transmission can be passive or active. "Obtaining" data or other information means acquiring such information. In some embodiments information is obtained by making physical measurements. In other embodiments information is obtained by receiving measurement data from a separate source.

Discussion of Principal Embodiments

In a first principal embodiment the invention provides a chemometrically controlled system for automated tank monitoring and butane blending comprising: (a) a fuel storage tank comprising a volume of tank fuel, wherein the tank fuel is characterized by type and a physical property selected from volatility, butane content, and density; (b) a variable rate butane blending unit comprising a tank fuel inlet, a tank fuel outlet, and a butane inlet; (c) a tank fuel circulating line comprising: (i) a tank fuel withdrawal line providing fluid communication between a tank fuel withdrawal port on the storage tank and the tank fuel inlet on the butane blending unit; (ii) a tank fuel return line providing fluid communication between the tank fuel outlet on the butane blending unit and a tank fuel return port on the storage tank; (d) a butane supply in fluid communication with the butane inlet on the butane blending unit; (e) a plurality of tank fuel sampling units, each comprising: (i) a sampling line providing fluid communication between a sampling port on the tank and a near infrared ("IR") analyzer capable of generating an absorption spectrograph of the tank fuel; and (ii) an optional sample return line providing fluid communication between the infrared analyzer and the tank; (f) an information processing unit ("IPU") comprising (i) access to a chemometric dataset corresponding to a range of physical properties of the tank fuel, and (ii) programming for performing the following IPU functions: receiving the spectrograph from the IR analyzer, comparing the spectrograph to the chemometric dataset, determining the physical property of the fuel, and generating a signal corresponding to the physical property; (g) performing a comparison of the physical property to a physical property limit; and (h) reducing the fluid communication of the butane supply in response to the comparison.

In a second principal embodiment the invention provides a system for automated tank blending comprising: (a) a fuel storage tank comprising a volume of tank fuel, wherein the tank fuel comprises a physical property selected from volatility, butane content, and density; (b) a variable rate butane blending unit comprising a tank fuel inlet, a tank fuel outlet, and a butane inlet; (c) a tank fuel circulating line comprising: (i) a tank fuel withdrawal line providing fluid communication between a tank fuel withdrawal port on the storage tank and the tank fuel inlet on the butane blending unit; (ii) a tank fuel return line providing fluid communication between the tank fuel outlet on the butane blending unit and a tank fuel return port on the storage tank; (d) a butane supply in fluid communication with the butane inlet on the butane blending unit; (e) a plurality of tank fuel sampling units, each comprising: (i) a sampling line providing fluid communication between a sampling port on the tank and a physical property analysis unit capable of measuring the physical property of the tank fuel and generating a signal corresponding to the measured physical property; and (ii) an optional sample return line providing fluid communication between the physical property analysis unit and the tank; and (f) an information processing unit ("IPU") comprising programming for performing the following IPU functions: receiving the signals from the sampling units, determining the physical property of the fuel, and generating a signal corresponding to the physical property; (g) performing a comparison of the physical property to a physical property limit; and (h) reducing the fluid communication of the butane supply in response to the comparison.

In a third principal embodiment the invention provides a chemometric method of automated tank blending comprising: (a) providing a fuel storage tank comprising a height and a volume of tank fuel within the tank; (b) periodically withdrawing samples of the tank fuel from the tank, at uniform intervals of time, from a plurality of locations along the height of the tank; (c) measuring the physical property of the samples in a near infrared ("IR") analyzer; (d) withdrawing tank fuel from the tank; (e) adding butane to the withdrawn tank fuel at a butane blending unit at a rate that will not cause a limit on the physical property to be exceeded; and (f) optionally returning the withdrawn tank fuel to the tank.

In a fourth principal embodiment the invention provides a method of automated tank blending comprising: (a) providing a fuel storage tank comprising a height and a volume of tank fuel within the tank; (b) periodically withdrawing samples of the tank fuel from the tank, at uniform intervals of time, from a plurality of locations along the height of the tank; (c) measuring the physical property of the samples in an automated physical property analysis unit; (d) withdrawing tank fuel from the tank; (e) adding butane to the withdrawn tank fuel at a butane blending unit at a rate that will not cause a limit on the physical property to be exceeded; and (f) optionally returning the withdrawn tank fuel to the tank.

Discussion of Subembodiments

In the most general sense, the systems and methods of the current invention include:

- a fuel storage tank;
- piping external to the tank that circulates the fuel from one side of the tank to the other (a "fuel loop");
- a butane blending unit for injecting butane into the fuel loop;
- an automated system for sampling the fuel inside the tank and determining a physical property of the fuel selected from volatility, butane content, and density; and
- a system for controlling the introduction of butane to the fuel loop based on the physical property of the fuel. This system can be manual, based on human readings of measurements of one or more physical properties of the fuel inside the tank, or it can be automated as more fully described herein.

The tank itself is a traditional vertical cylindrical fuel tank of the type commonly found at petroleum tank farms, some storing up to 500,000 barrels of fuel. The storage tank has a circular cross section on its vertical axis, with a fuel withdrawal port and a fuel return port separated by at least 120 degrees on the vertical axis. The tank will usually be equipped with a floating roof that minimizes vapor space inside the tank to minimize evaporation of the fuel.

Some tanks are already equipped with external piping that circulates fuel from one side of the tank to the other. If not, it will be necessary to install this piping, which can usually be accomplished by installing piping that connects a tank input line with a tank discharge line, incorporating suitable valves and backchecks into the piping for controlling the direction of liquid flow, and installing a pump into the piping for transmitting the fuel through the fuel loop. Alternatively, entirely new connections to the tank can be established for withdrawing fuel from the tank and reintroducing the fuel to the fuel tank after it has been blended with butane.

Tank farms often store many types of fuel, but the methods and systems of the present invention are practiced only with fuels suitable for blending with butane, and tanks dedicated to storing such fuels. Thus, the methods and systems will most often be practiced with gasoline or diluents, as those terms are defined in the definitions section of this document.

The butane injection unit can function either my modulating the flow of butane along a continuum, or simply by starting and stopping the flow of butane. In either case it can be referred to herein as a variable rate unit. The butane injection unit will commonly include a valve positioned between a source of butane and the fuel loop. The valve can an on/off valve, or it can include an adjustable orifice so that the rate of injection can be controlled by modulating the size of the orifice. The rate of butane injection into the fuel loop will thus be a function of the pressure at which butane is supplied to the valve, the pressure at which butane exits the valve, and the pressure of the fuel in the fuel loop at the butane injection point. These pressures can be controlled by techniques well known to workers of skill in the art, based on the diameter of the piping used to carry the butane and the fuel, the output of the pumps used to transmit the butane and fuel through the piping, the valves integrated into the piping, the length of the piping, and the physical properties of the fuel being pumped.

The butane and fuel pumps can be fixed displacement or variable displacement, but in a preferred embodiment they are fixed displacement pumps for producing substantially constant rates of butane and fuel flow during operation of the systems of the present invention. The butane and fuel will commonly be blended at the butane injection point at a ratio of from 1:20 to 1:1, and more commonly from 1:10 to 1:1.5 or from 1:8 to 1:1.5, based on their volumetric flow rates. In a preferred embodiment, this ratio will remain constant, and will not be disturbed, until the fuel in the tank is approaching its maximum volatility or physical property limit, at which time the ratio will be stopped completely or reduced in increments until the fuel in the tank reaches its maximum volatility or physical property limit and the butane flow ceases.

Thus, in any of the systems or methods of the current invention, the variable rate butane blending unit, and the surrounding piping and fuel loop, are preferably configured to blend a fixed ratio of butane into the fuel circulating line, and to reduce the ratio in response to a reduction signal from the IPU, or to be manually adjusted or turned off in response to physical property measurements taken of the fuel tank.

As butane is being injected into the system, the volatility of the fuel inside the tank is gradually increasing and is constantly being monitored to ensure that any prescribed limits on fuel volatility are not violated. The monitoring system generally includes multiple sampling ports on the tank at various heights on the tank. By averaging the volatilities of the fuel at different heights on the tank, the overall volatility of the tank, and the overall volume of butane that can be added to the tank, can most accurately be determined. This accuracy can be even further improved by mixing the contents of the tank using a circulating nozzle. The foregoing description is given specifically in reference to volatilities, but it will be understood also to apply to butane content and densities.

Samples are continuously withdrawn from the tank and transmitted on an automated basis to one or more volatility analysis units in order to continuously monitor the volatility of the fuel inside the tank. Various devices are commercially available for measuring the volatility of the samples, or generating data corresponding to such volatility, and communicating the volatility or other associated data to an appropriate information processing unit although, as discussed elsewhere in this document, the IR analyzer is preferred because of its ability to analyze samples rapidly, and to analyze many more samples in a shorter period of time. Once again, the foregoing description is given specifically in reference to volatilities, but it will be understood also to apply to butane content and densities.

After the physical property of the fuel is determined, it can either be transmitted to a display for manual inspection, or transmitted to an IPU which will compare the fuel's physical property to a physical property limit for the fuel and calculate the amount of butane that can be added to the fuel without violating the physical property limit. The amount can correspond to a percentage of butane that can be added to the fuel, an absolute flow rate for the butane, or any other appropriate measure depending on the precise algorithms implemented in the software. The IPU then controls the butane injection rate by generating a blending signal and communicating that signal to the butane blending unit.

Numerous methods exist for calculating the ratio of butane that can be blended with a mixture of a given volatility to achieve a pre-defined volatility parameter, and these methods can be readily adapted to the butane injection methods and systems of the current invention. U.S. Pat. Nos. 7,032,629 and 6,679,302, PCT Patent Application No. WO/2007/124058, and U.S. Pat. App. No. 2006/0278304, the contents of which are hereby incorporated by reference, describe such methods of calculation. The blend ratio of butane to gasoline required to attain the fixed volatility can be determined simply by direct volumetric averaging of the volatility of the butane and the blended gasoline. However, it has been noted in the literature that volumetric averaging can yield low estimates of resultant volatility, especially when the amount of butane added is less than 25%. Methods for determining blend ratios to attain a prescribed volatility which overcome these limitations are set forth more fully in "How to Estimate Reid Vapor Pressure (RVP) of Blends," J. Vazquez-Esparragoza, *Hydrocarbon Processing*, August 1992; and W. E. Stewart, "Predict RVP of Blends Accurately," *Petroleum Refiner*, June 1959; and N. B. Haskell et al., *Industrial and Engineering Chemistry*, February 1942; and M. R. Riazi et al., "Prediction of the Reid Vapor Pressure of Petroleum Fuels," *Fuel Chemistry Division Preprints* (Amer. Chem. Soc.), 48(1):478 (2003); the disclosure from each being hereby incorporated by reference as if fully set forth herein.

In still other systems and methods, the tank's contents are additionally analyzed for physical properties other than volatility, butane content, or density, or for multiple measures of volatility. The measurements can be taken as part of the blending control process, or to ensure that the fuel maintains its specifications after the blending operation. Suitable physical properties include, for example, sulfur content, octane, molecular weight distributions, flash point, and API gravity. When an IR unit is used to measure the physical property, these additional tests can be performed on the same IR unit, preferably using the same samples drawn from the tank. However, it is also possible to incorporate other types of analyzers into the system. Thus, for example, a suitable sulfur analyzer is the Sindie® 6010 On-line MWD XRF Analyzer by XOS® products. A suitable analyzer for flash point is the FDA-5™ Flash Point Analyzer by Bartec Top Holding GmbH. Molecular weight can suitably analyzed by a MAXUM™ gas chromatograph by Siemens Analytical Products.

One or more of these additional physical properties can be monitored, depending on the type of fuel, preferably at a frequency of at least every 10 minutes, 5 minutes, 60 seconds, 30 seconds, 15 seconds, or 10 seconds, regardless of the physical property being monitored. When the analysis is complete, the samples can either be returned to the tank or sent to a separate storage unit.

Near Infra-Red (NIR) Spectroscopy

A preferred technique for measuring the physical property of the fuel is near infra-red ("NIR") spectroscopy. To perform an NIR measurement either an immersion probe or a flow cell is commonly used. Immersion probes are most widely used for Fourier transform near infrared (FT-NIR) measurements in process control and can work in a transmission mode or a reflection depending on the transmittance of the sample. For refined fuels, transmission can be the most appropriate. Besides immersion probes, flow cells are also widely used. In this case, the sample flows directly through the cell where the spectrum is measured exclusively in transmission mode. Typically, a flow cell probe allows one to acquire the spectra of a fluid flowing in a pipe at a high pressure, while the immersion probe is designed to measure at pressures close to atmospheric.

A large number of properties can be measured with NIR spectroscopy. Those properties include, without limitation, RON (research octane number), MON (motor octane number), % aromatics, % olefins, % benzene and % oxygenates, to RVP, D10%, D50%, D90%, Pour Point, and Cloud Point. Suitable NIR analyzers are the OMA 300 by Applied Analytical, having a spectral range of 400-1100 nm, ANALECT® PCM™ Series by Applied Instrument Technologies, having a spectral range of 833-8333 nm, the HP260X by ABB, having a spectral range of 714-2630 nm, the XDS Process Analytics™ by FOSS NIR Systems Inc., having a spectral range of 800-2200 nm, and the PetroScan™ by Light Technology Industries, Inc., having a spectral range of 1200-2400 nm. NIR spectroscopy is particularly well adapted to any of the volatility measures of the current invention (i.e. RVP, vapor liquid ratio, distillation temperature, true vapor pressure, dry vapor pressure equivalent, and butane percentage).

The IR spectrograph is generated using techniques known generally in the art, under conditions commonly employed in the art. However, it has been found advisable to precondition the samples to a narrow range of temperatures preferably ranging from 80 to 100° F., most preferably about 90° F.

Chemometrics

The NIR spectrograph generated by the NIR unit is evaluated for the physical property of the sample using chemometrics technology. "Chemometrics" refers to the discipline of integrating computers and mathematics into a process for deriving meaningful chemical information from samples of varying complexity (Workman, J. J., Jr (2008) NIR spectroscopy calibration basic. In: Burns, D. A. and Ciurczak, E. W. (eds), Handbook of Near-Infrared Analysis, 3rd edn. CRC Press, Boca Raton, FL). In chemometrics, a computer is tasked with interpreting NIR spectra from a plurality of samples using a variety of multivariate mathematical techniques. These techniques are used to produce a mathematical calibration model.

In routine NIR analysis, the spectra should be pretreated to enhance informative signals of the interested components and reduce uninformative signals as much as possible (Pantoja P A et al., Application of Near-Infrared Spectroscopy to the Characterization of Petroleum, in Analytical Characterization Methods for Crude Oil and Related Products, First Edition. Edited by Ashutosh K. Shukla. Published 2018 by John Wiley & Sons Ltd.). Smoothing, multiplicative scatter correction, mean centering, and Savitzky-Golay derivation are commonly applied to pretreat the spectra before modeling in order to remove the scattering effect created by diffuse reflectance and to decrease baseline shift, overlapping peak, and other detrimental effects on the signal-to-noise ratio (Boysworth, M. K. and Booksh, K. S. (2008) Aspects of multivariate calibration applied to near-infrared spectroscopy. In: Burns, D. A. and Ciurczak, E. W. (eds), Handbook of Near-Infrared Analysis, 3rd edn. CRC Press, Boca Raton, FL).

NIR spectra are ultimately calibrated to relate the observed spectra, in a predictive manner, to a property of interest. With calibration it is possible to predict relevant physicochemical properties of an unknown hydrocarbon that compare accurately with reference information on these properties. The main calibration methods, as described by López-Gejo et al., 2008, include principal component analysis (PCA), partial least squares (PLS) regression, and artificial neural networks (ANNs) (López-Gejo, J., Pantoja, P. A., Falla, F. S., et al. (2008) Electronical and vibrational spectroscopy. In: Petroleum Science Research Progress, Publisher, Inc., 187-233).

Thus, when a chemometric dataset is referred to as "corresponding" to a range of volatilities, it will be understood that the chemometric dataset has been calibrated to predict the relevant physical property. In like manner, when a spectrograph is said to be compared to the chemometric dataset, it will be understood that the spectrograph can be directly compared to the chemometric dataset, or indirectly compared after manipulation of the spectrograph, all depending on the algorithms developed to accomplish such comparison and to generate a value for the fuel's physical property.

In the process of this invention, the reference information is generated from reference samples of fuel of the same type of fuel as the tank fuel being blended with butane. The fuel type for the reference samples is preferably as close to the fuel type as the fuel into which the butane will be blended as possible. Different fuel types are described specifically in the definitions section of this document.

Thus, in other methods and systems of the present invention, the value for the physical property is obtained by generating a spectral response of the fuel using absorption spectroscopy with a near infrared analyzer and comparing the spectral response to a chemometric dataset specific for said physical property using the same type of fuel. In one particular embodiment, the amount of butane that can be blended with the fuel is determined by (i) generating a spectrograph by the IR analyzer; (ii) accessing a chemometric dataset corresponding to a range of physical properties of the fuel, (iii) comparing the spectrograph to the chemometric dataset to determine the physical property of the fuel, (iv) accessing a physical property limit for the fuel, and (v) comparing the physical property of the fuel to the physical property limit.

The reference samples used to generate the chemometric dataset should be analyzed under substantially the same conditions as the fuel in the tank is analyzed, particularly in terms of temperature. Thus, in preferred embodiments, the reference samples will be heated to a temperature of from 80 to 100° F. prior to analysis, most preferably approximately 90° F. The chemometric dataset and physical property can be stored on the IPU that performs the comparison to the spectrograph or stored on a separate informational database.

Discussion of Depicted Embodiments

Referring to FIG. 1, there is shown a conventional gasoline storage tank 100 with a gasoline loop 110 that circulates gasoline from an outlet port 108 on the tank to an inlet port 104 on the opposite side of the tank. Loop 110 terminates in an inlet line 101 that introduces fresh gasoline to the tank through a nozzle at inlet port 104. The storage tank is filled with a volume of gasoline 105 which shown circulating throughout the inside of the tank in FIG. 1 due to the velocity created by nozzle 104. The flow rate through inlet port 104, and the overall circulation of gasoline through the volume of the tank, can be modulated by valve 106, depending primarily on the rate of flow through gasoline loop 110.

An alternative configuration for introducing fresh gasoline to the tank employs a combination of (i) a large diameter entry port for piping gasoline directly into the tank from inlet line 101, with a diameter corresponding to the diameter of line 101, and (ii) a T-junction off of line 101 directing fuel toward inlet port 104 and the nozzle injector. This alternative configuration can reduce the agitation caused by the nozzle when large volumes of fuel are pumped through inlet port 104, and thereby reduce emissions of butane from the tank. In a preferred embodiment, gasoline will be introduced to the tank simultaneously through the large diameter entry port and inlet port 104, so that gasoline can be rapidly circulated through fuel loop 110 while continuously blending the gasoline through the nozzle to produce a homogenous blend.

Tank 100 is further equipped with an outlet port 108 leading to valve 107 and circulation pipe 102. Gasoline exiting the tank flows through a strainer 112 before reaching a valve 113 and pump 114. Gasoline ejected from pump 114 flows through valve 115 and a backcheck 116 before passing through valve 117 and either continuing on gasoline loop 110 or leaving the system toward a loading rack through pipe 118. Gasoline that remains in gasoline loop 110 then travels through pipe 120, through valve 121, and through a second backcheck before reaching junction 123 with butane injection pipe 124. Following injection of butane at junction 123, the gasoline continues through pipe 101 and valve 106 before returning to tank 100 through inlet port 104.

Referring to FIG. 1 there is also illustrated a butane truck unloading station 300 connected to gasoline loop 110 through pipe 124. Butane is introduced to unloading station 300 through butane trucks (not shown) connected to the system through a flexible hose 301 and reducing coupling 302. These trucks are commonly equipped with pumps capable of pumping greater than 100 gallons per minute of butane into the system. Of course, it will be understood that the butane can also be supplied to the system through a butane storage tank maintained at the tank farm. The butane passes through reducing coupling 302 and flows through pipe 303 towards pipe 124 and gasoline loop 110. Interposed between pipe 303 and pipe 124 is a backcheck 304, a basket strainer 305, and a failsafe close valve 306 for safety purposes or for automation of the butane blending operation. The failsafe close valve 306 can be under the control of emergency pulls mounted at the reducing coupling valve 302 and an emergency pull station, or, when butane blending rates are automated, under the control of the IPU.

Figure 2:
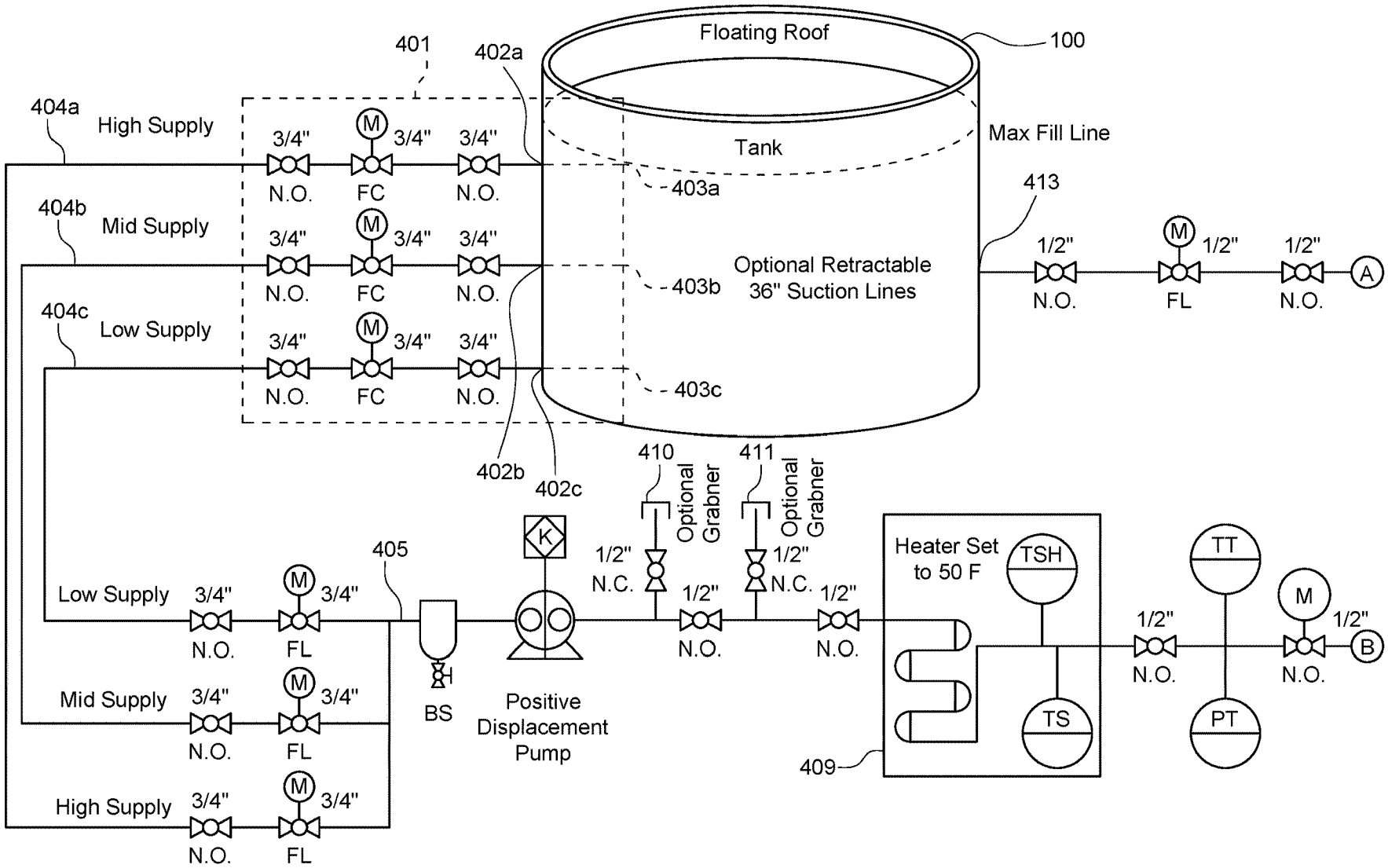
FIG. 2 is a plan layout of an exemplary system for analyzing the physical properties of gasoline in a storage tank on a real time basis, showing the flow of gasoline through the system and the analytical units.
Figure 2:
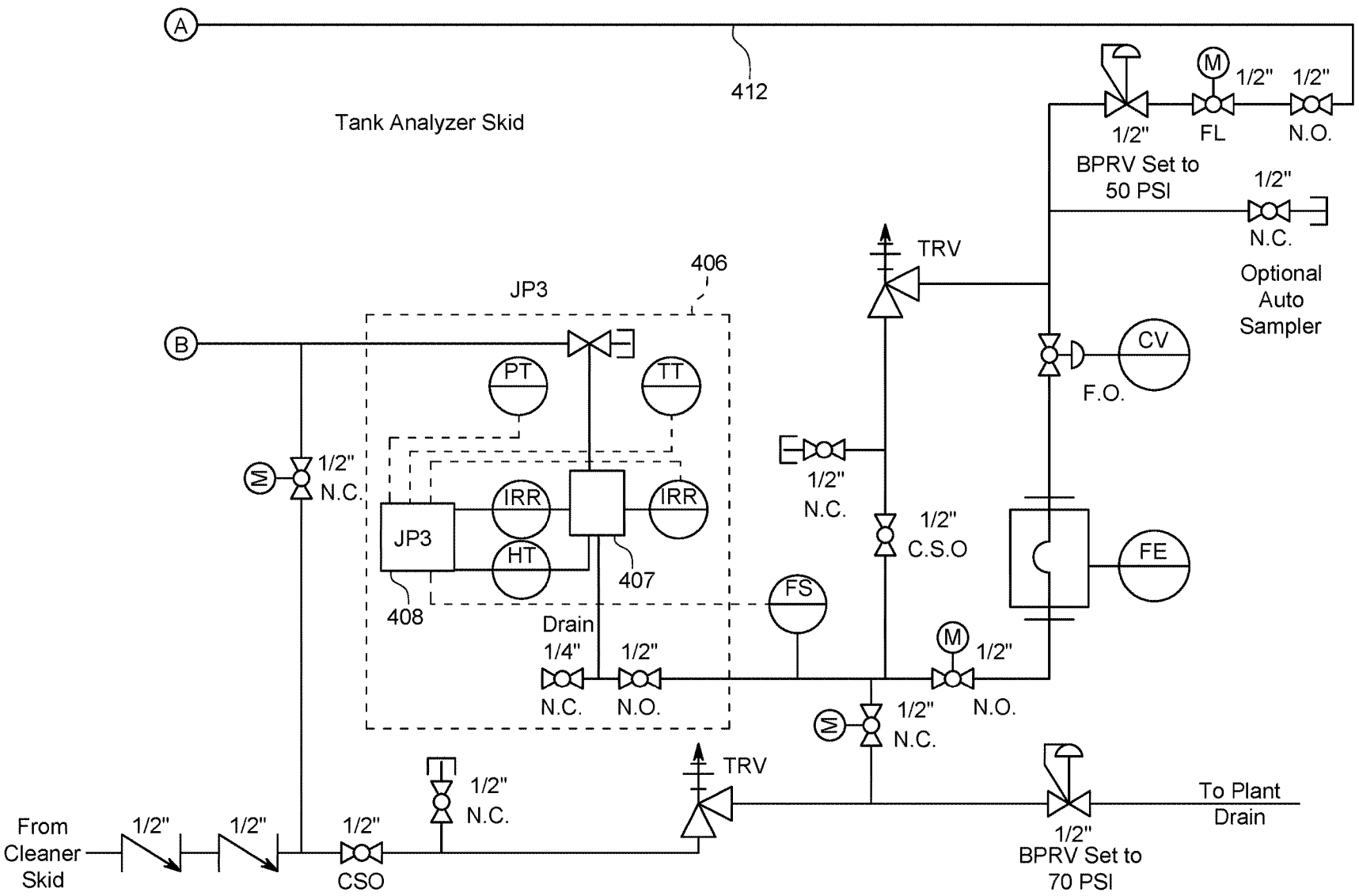

Referring to FIG. 2, there is illustrated a system for analyzing the RVP of the gasoline 105 in tank 100 real time. Sampling station 401 includes three sampling ports 402*a*, 402*b*, and 402*c*, optionally equipped with retractable suction tubes 403*a*, 403*b*, and 403*c*, for reaching further into the volume of the tank. Sampling ports 402*a-c* are positioned at different levels along the height of the tank in order to draw representative samples of gasoline from different segments of the tank volume.

After the gasoline is withdrawn through sampling ports 402*a-c*, it flows through three separate lines, high supply line 403*a*, mid supply line 403*b*, and low supply line 403*c*, before merging into merged line 405.

Sampling station 401 is equipped with an infra-red ("IR") analytical unit 406, including units 407 and 408 for generating an IR spectrograph of the fuel in merged line 405, and transmitting the spectrograph to a separate IPU for chemometric analysis. Immediately preceding IR unit 406 is a conditioning station 409 for heating the fuel to an acceptable temperature before introducing the fuel to IR unit 406 for analysis. Also illustrated are two optional analytical units 410 and 411 which can perform various functions, including quality control for ensuring the integrity of data generated by IR unit 406, performing analyses of additional physical properties of the fuel, and for generating additional chemometric data sets for training the chemometric process. After analysis in IR unit 406, the samples of fuel are returned to the tank though line 412 and injection port 413.

OTHER EMBODIMENTS

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A system for automated tank monitoring and butane blending comprising:

a) a fuel storage tank comprising a volume of tank fuel, a withdrawal port, a return port, and a plurality of monitoring units, wherein:
   i) the tank fuel is characterized by a type and a physical property selected from volatility, butane content, and density; and
   ii) each of the tank fuel monitoring units is capable of measuring the physical property of the tank fuel via absorption spectroscopy and generating a physical property signal corresponding to the measured physical property;

b) a variable rate butane blending unit under the control of an information processing unit;

c) a tank fuel circulating line comprising:
   i) a tank fuel withdrawal line in fluid communication with the storage tank, configured to withdraw fuel from the storage tank through the storage tank withdrawal port;
   ii) a junction providing fluid communication between the tank fuel recirculating line and the butane blending unit, configured to transmit butane from the butane blending unit into the circulating line to produce butane enriched fuel having a ratio of butane to fuel; and
   iii) a tank fuel return line in fluid communication with the storage tank, configured to return the butane enriched fuel to the storage tank through the storage tank return port;
d) the information processing unit ("IPU") comprising programming for receiving the physical property signal, performing a comparison of the physical property corresponding to the physical property signal to a physical property limit, and adjusting the ratio of butane to fuel in response to the comparison.

2. The system of claim 1, wherein the physical property corresponding to the physical property signal is determined by reference to a chemometric dataset built by taking two or more reference samples of the same fuel type as the tank fuel; measuring the physical property of the reference samples; obtaining spectral responses of the reference samples using absorption spectroscopy; and correlating the spectral response with the physical property samples.

3. The system of claim 2, wherein the fuel type is selected from conventional gasoline, oxygenated gasoline such as gasohol, reformulated gasoline, reformulated blendstock for oxygenate blending, and conventional blendstock for oxygenate blending.

4. The system of claim 2, wherein the chemometric dataset is stored on the IPU.

5. A system for automated tank blending comprising:
a) a fuel storage tank comprising a volume of tank fuel, a withdrawal port, a return port, and a plurality of tank fuel sampling units, wherein:
   i) the tank fuel comprises a physical property selected from volatility, butane content, and density; and
   ii) each of the tank fuel sampling units comprises a sampling line providing fluid communication between a sampling port on the tank and a physical property analysis unit capable of measuring the physical property of the tank fuel and generating a physical property signal corresponding to the measured physical property, and an optional sample return line providing fluid communication between the physical property analysis unit and the tank;
b) a variable rate butane blending unit under the control of an information processing unit;
c) a tank fuel circulating line comprising:
   i) a tank fuel withdrawal line in fluid communication with the storage tank, configured to withdraw fuel from the storage tank through the storage tank withdrawal port;
   ii) a junction providing fluid communication between the tank fuel recirculating line and the butane blending unit, configured to transmit butane from the butane blending unit into the circulating line to produce butane enriched fuel having a ratio of butane to fuel; and
   iii) a tank fuel return line in fluid communication with the storage tank, configured to return the butane enriched fuel to the storage tank through the storage tank return port;

wherein the information processing unit ("IPU") comprises programming for receiving the physical property signal, performing a comparison of the physical property corresponding to the physical property signal to a physical property limit, and adjusting the ratio of butane to fuel in response to the comparison.

6. The system of claim 5, wherein the butane blending unit is under the control of the IPU, and the IPU further comprises programming for performing the following IPU functions: accessing the limit on the physical property for the tank fuel, calculating an amount of butane that can be added to the tank fuel without violating the physical property limit, generating a blending signal corresponding to the calculated amount, and communicating the blending signal to the butane blending unit.

7. The system of claim 5, wherein the physical property limit is stored on the IPU.

8. The system of claim 5, wherein the IPU comprises a plurality of interconnected processing units programmed to perform the IPU functions in tandem.

9. The system of claim 5, wherein the IPU controls the butane inlet by communicating the blending signal to the butane blending unit.

10. The system of claim 5, wherein the tank fuel is selected from gasoline and diluents.

11. The system of claim 5, wherein the physical property is volatility, and the volatility and volatility limit are selected from Reid Vapor Pressure ("RVP"), vapor liquid ratio, distillation temperature, dry vapor pressure equivalent, true vapor pressure, and butane percentage.

12. The system of claim 5, wherein:
a) the fuel storage tank has a circular cross section on its vertical axis; and
b) the tank fuel withdrawal port and tank fuel return port are separated by at least 120 degrees on the vertical axis.

13. The system of claim 5, wherein the tank comprises a height, and the tank fuel sampling units are at different locations along the height of the tank.

14. The system of claim 5, wherein the variable rate butane blending unit is configured to blend a fixed ratio of butane into the tank fuel circulating line, and to reduce the ratio in response to a reduction signal from the IPU.

15. The system of claim 5, wherein the tank fuel circulating line further comprises a junction interposed between the tank and the butane blending unit capable of disrupting the circulation of tank fuel between the tank fuel withdrawal port and the tank fuel return port and withdrawing tank fuel from the system.

16. A system for automated tank monitoring and butane blending comprising:
a) a fuel storage tank comprising a volume of tank fuel, a withdrawal port, a return port, and one or more monitoring units, wherein:
   i) the tank fuel is characterized by a type and a physical property selected from volatility, butane content, and density; and
   ii) the one or more tank fuel monitoring units are capable of measuring the physical property of the tank fuel and generating a physical property signal corresponding to the measured physical property;
b) a variable rate butane blending unit under the control of an information processing unit;

c) a tank fuel circulating line comprising:

i) a tank fuel withdrawal line in fluid communication with the storage tank, configured to withdraw fuel from the storage tank through the storage tank withdrawal port;

ii) a junction providing fluid communication between the tank fuel recirculating line and the butane blending unit, configured to transmit butane from the butane blending unit into the circulating line to produce butane enriched fuel having a ratio of butane to fuel; and iii) a tank fuel return line in fluid communication with the storage tank, configured to return the butane enriched fuel to the storage tank through the storage tank return port;

d) the information processing unit ("IPU") comprising programming for receiving the physical property signal, performing a comparison of the physical property corresponding to the physical property signal to a physical property limit, and adjusting the ratio of butane to fuel in response to the comparison.

* * * * *